US006256807B1

(12) United States Patent
Steadman

(10) Patent No.: US 6,256,807 B1
(45) Date of Patent: Jul. 10, 2001

(54) BATH LIFT

(75) Inventor: William David Steadman, Stuart, FL (US)

(73) Assignee: Silver Crown Associates Limited (GB)

( * ) Notice: Subject to any disclaimer, the term of this patent is extended or adjusted under 35 U.S.C. 154(b) by 0 days.

(21) Appl. No.: 09/424,738

(22) PCT Filed: May 28, 1998

(86) PCT No.: PCT/GB98/01570

§ 371 Date: Nov. 30, 1999

§ 102(e) Date: Nov. 30, 1999

(87) PCT Pub. No.: WO98/55068

PCT Pub. Date: Dec. 10, 1998

(51) Int. Cl.[7] ..... A47K 3/02

(52) U.S. Cl. ..... 4/562.1; 4/561.1; 4/563.1; 4/564.1; 4/565.1

(58) Field of Search ..... 4/560.1, 561.1, 4/562.1, 563.1, 564.1, 565.1, 566.1, 420.2, DIG. 5; 414/663, 921

(56) References Cited

U.S. PATENT DOCUMENTS

| | | | | |
|---|---|---|---|---|
| 3,268,918 | | 8/1966 | Batty et al. . | |
| 3,730,176 | | 5/1973 | Miller . | |
| 3,815,163 | | 6/1974 | Sullivan . | |
| 3,983,584 | * | 10/1976 | Holecek | 414/921 |
| 4,028,745 | * | 6/1977 | Caniglia | 4/420.2 |
| 4,091,478 | * | 5/1978 | Hardwick et al. | 4/562.1 |
| 4,598,432 | * | 7/1986 | Pennington-Richards | 4/563.1 |
| 4,633,538 | * | 1/1987 | James | 4/564.1 |
| 4,709,426 | * | 12/1987 | Godwin, Jr. | 4/DIG. 5 |
| 4,712,788 | * | 12/1987 | Gaudreau, Jr. | 4/496 |
| 4,733,418 | * | 3/1988 | Luther | 4/563.1 |
| 4,928,330 | | 5/1990 | Moore . | |
| 4,951,328 | * | 8/1990 | Potvin | 4/560.1 |
| 5,129,112 | | 7/1992 | Schaffer . | |
| 5,146,638 | * | 9/1992 | Richards | 4/562.1 |
| 5,201,084 | * | 4/1993 | Johnson | 4/561.1 |
| 5,263,207 | * | 11/1993 | Gilbert | 4/562.1 |
| 5,279,004 | | 1/1994 | Walker . | |
| 5,329,651 | | 7/1994 | Mardero et al. . | |
| 5,465,433 | * | 11/1995 | Nolan | 4/563.1 |
| 5,477,574 | * | 12/1995 | Skoe | 4/560.1 |
| 5,715,545 | * | 2/1998 | Forwick | 4/563.1 |
| 5,924,147 | * | 7/1999 | Clark et al. | 4/562.1 |

FOREIGN PATENT DOCUMENTS

| | | |
|---|---|---|
| 30 02 149 A 1 | 1/1980 | (DE) . |
| 196 03 277 A1 | 1/1996 | (DE) . |
| 2 123 285 | 7/1983 | (GB) . |
| 2 315 733 | 7/1997 | (GB) . |

* cited by examiner

*Primary Examiner*—Gregory L. Huson
*Assistant Examiner*—Khoa Huynh
(74) *Attorney, Agent, or Firm*—Watts, Hoffman, Fisher and Heinke Co. LPA

(57) ABSTRACT

A bath lift for assisting a person into and out of a bath tub is disclosed. The lift includes a tower mounted adjacent or atop a bath tub. The tower includes structure for attachment of the tower to a wall adjacent the tub or to the tub when the lift is in use. The tower defines a spaced pair of tracks, reciprocatably mounting a carriage by rollers engaged with the tracks. An elongate threaded member is rotatably mounted in the tower and operably engaging the carriage. A drive is connected to the member to effect member rotation thereby causing longitudinal movement of the carriage relative to the tower as coaction of the tracks and rollers guides movement when the lift is in use. An occupant chair including a seat and a back is supported by the carriage. The chair as also mounted on the support for rotation about a horizontal axis when the lift is in use to enable adjustment of the chair back for occupant comfort.

1 Claim, 9 Drawing Sheets

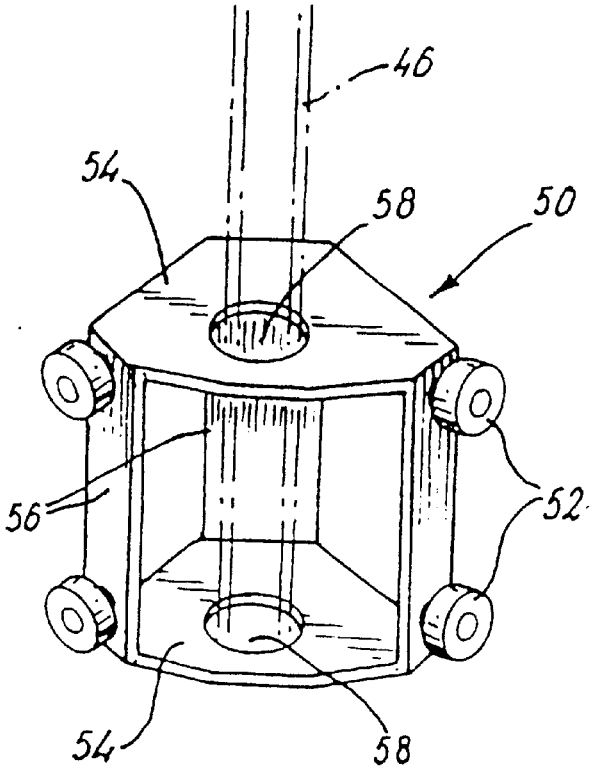
FIG. 3
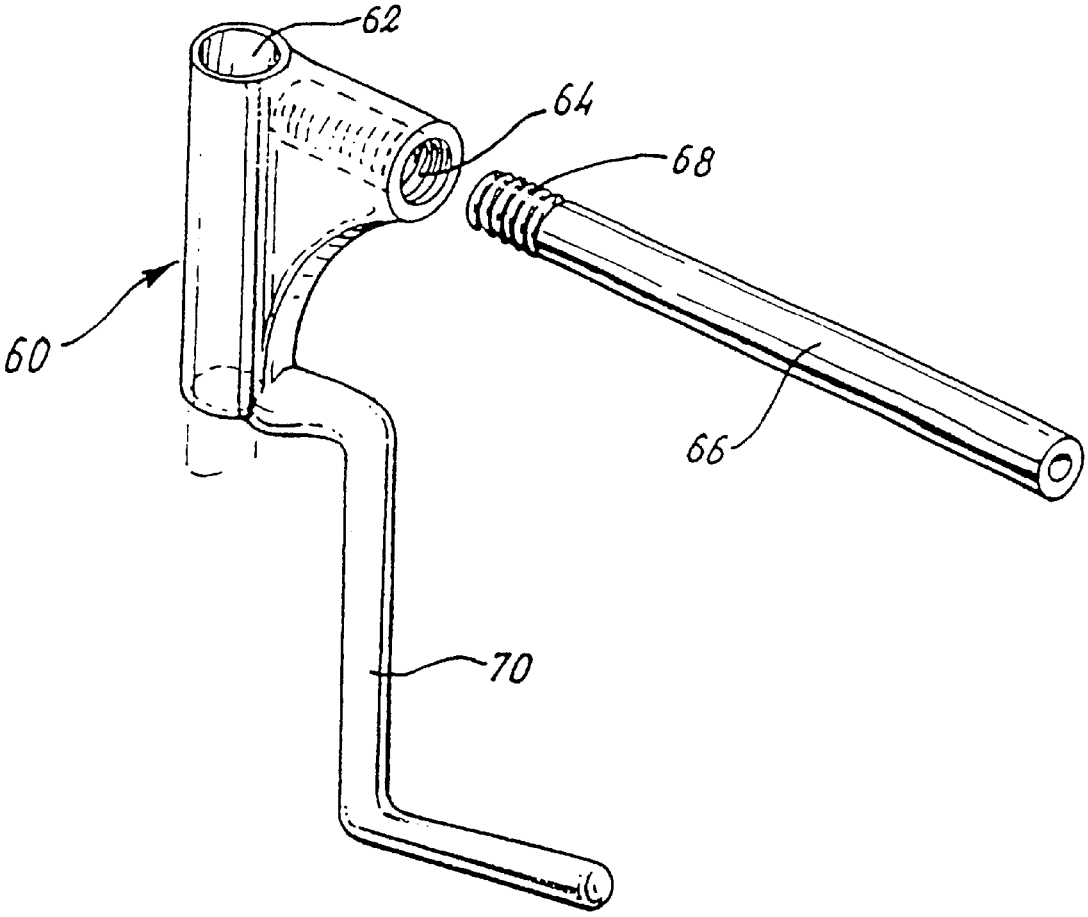

BATH LIFT

This invention concerns a bath lift for lifting persons into and out of a bath.

A large number of people encounter difficulties getting into and especially out of baths. A number of bath lifts are currently available. Many of these have proved somewhat unsatisfactory for a number of reasons, such as: occupying too much space, being difficult to operate, and particularly by a user; being not sufficiently stable; requiring considerable installation time and hence costs; or being too expensive for the limited usefulness of most of the bath lifts on offer.

According to the present invention there is provided a bath lift, the bath lift comprising a lifting arrangement mountable to a wall or fixture, and a seating means mountable on the lifting arrangement, the lifting arrangement comprising means for selectively moving the seating means in a generally vertical direction, whereby to permit a person to be lowered into a bath or raised out thereof, the seating means being pivotally movable in a generally horizontal plane relative to the lifting arrangement, and the seating means being selectively mountable on the lifting arrangement to face in either a one or an opposite direction.

The seating means is preferably mountable on the lifting arrangement to be freely pivotally movable about a generally horizontal axis. Means may be provided to prevent the seating means from pivoting rearwardly beyond a predetermined point, and said pivotting preventing means may comprise an engagement member locatable behind the seating means irrespective of whether the seating means is facing in a one or an opposite direction.

Bath engagement means may be provided on the underside of the seating means engageable with the side, end and/or base of a bath to allow the seating means to move thereover during raising or lowering. Said bath engagement means may comprise one or more roller means or similar.

The seating means may comprise a base and a back part, and the base may be pivotally mounted to the back part so as to be movable into an out-of-use position generally parallel to the back part.

An arm rest may be provided on the back part, part way along the length thereof, and the arm rest may be pivotally mounted on the back part to be selectively movable in and out of an in-use position.

Rib reinforcements and/or openings may be provided in the seating means. Means may be provided for blowing air through the seating means on to a person seated thereon, whereby to provide a spa-type effect.

Also according to the invention there is provided a bath lift, the bath lift comprising a lifting arrangement and seating means mountable thereto, the lifting arrangement comprising means for selectively moving the seating means in a generally vertical direction whereby to permit a person to be lowered into a bath or raised out thereof, the seating means being engageable with a lifting part of the lifting arrangement, which lifting part is selectively movable in a generally vertical direction so as to raise or lower the seating means.

In addition to the above paragraph, the bath lift may also be according to any of the six paragraphs preceding the above paragraph.

The seating means may be mountable on a holding part of the lifting arrangement which is freely slidably locatable in a generally downwards direction on the lifting part, whereby the seating means and said holding part can be located on the remainder of the lifting arrangement or removed therefrom, simply by movement in a generally vertical direction.

Said holding part may comprise an elongate sleeve. Said lifting part may comprise a sleeve threadably mounted on an elongate threaded member. The top end of the lifting part is preferably engageable with the holding part to cause raising and lowering thereof. Non-rotatable engagement means may be provided between the holding and lifting parts, and a respective non-circular section projection may be provided on one of said parts locatable in a correspondingly shaped recess in the other of said parts. The seating means is preferably mountable on a carriage mounted on said holding part.

Alternatively, the seating means may be mountable on the lifting part. Said lifting part may comprise a sleeve threadably mounted on the elongate threaded member. The seating means is preferably mountable on a carriage mounted on said lifting part.

Cover means may be provided for the threaded member above and/or below the seating means. The cover means may comprise a flexible sleeve or sleeves locatable around the threaded member. The sleeve or sleeves may have a bellows configuration.

The threaded member may be mounted on a motor, and extendible substantially vertically therefrom in use.

An elongate projection may be provided on the carriage for mounting the seating means, and the seating means preferably comprises a sleeve in which the elongate projection is locatable to permit free pivotal movement of the seating means. The carriage may also mount the engagement member, which preferably comprises a further elongate member which may be cranked.

The lifting arrangement may comprise a track or tracks in which a part of the carriage is movable during raising or lowering of the seating means. Preferably two tracks are provided, and a plurality of roller means or similar may be provided on the carriage, engageable respectively in the track or in respective tracks.

The lifting arrangement preferably comprises a frame member which has a generally L-shaped cross-section in plan view, with the tracks desirably provided respectively at the free ends of the limbs of the L. Channels may be provided at the free ends of the limbs of the L to define the tracks.

The frame member may be directly mountable to a wall or fixture. Alternatively, the frame member may be mountable on the floor so as to be upstanding therefrom. Means may be provided for engagement between the frame member and an adjacent bath to substantially prevent relative movement therebetween. The engagement means may be adjustable. The engagement means may comprise a generally L-shaped member engageable over the side of the bath. The engagement means may comprise a further member mountable on the frame member at a required height, and formed to adjustably mount a limb of the L-shaped member. The further member may comprise an elongate socket and locking means to receive a limb of the L-shaped member therein. A plurality of spaced holes may be provided along the height of the frame member to receive the further member at a required height.

As an alternative to direct mounting a mounting bracket may be provided. The mounting bracket preferably also has a generally L-shaped cross-section in plan view, and the frame member may be slidably mountable thereon.

The lifting arrangement preferably comprises a motor which may include reduction gearing. The motor may be mains operable or batteries may be provided therefor.

In one arrangement the lower end in use of the frame member is enclosed so as to be generally only upwardly open. The motor is preferably slidably located in said lower end of the frame member.

In an alternative arrangement the upper end of the frame is enclosed, and the motor is removably located therein.

Control means may be provided for the bath lift, and the control means are preferably waterproof and may be arranged so as to be hand-held if required by a person on the seating means. The control means may be arranged such that the lifting arrangement automatically stops when the seating means reaches a predetermined upper or lower position. The upper and/or lower positions may be variable.

The invention further provides a bath lift assembly, the assembly comprising two bath lifts according to any of the preceding twenty one paragraphs, the bath lifts being mountable spaced from each other adjacent a bath, with a support member extending between each bath lift and movable into and out of the bath by virtue of synchronised operation of the bath lifts, whereby to permit a supine or partially supine person to be lowered into a bath.

The invention still further provides a toilet lift assembly, the assembly comprising a bath lift according to any of said preceding twenty one paragraphs, the bath lift being locatable adjacent a toilet so as to permit a person to be lowered onto the toilet, the seat member being in the form of a toilet seat.

Embodiments of the present invention will now be described by way of example only with reference to the accompanying drawings, in which:

FIGS. 3 to 7 are diagrammatic perspective views of different parts of the lift of FIG. 1;

Figure 4:
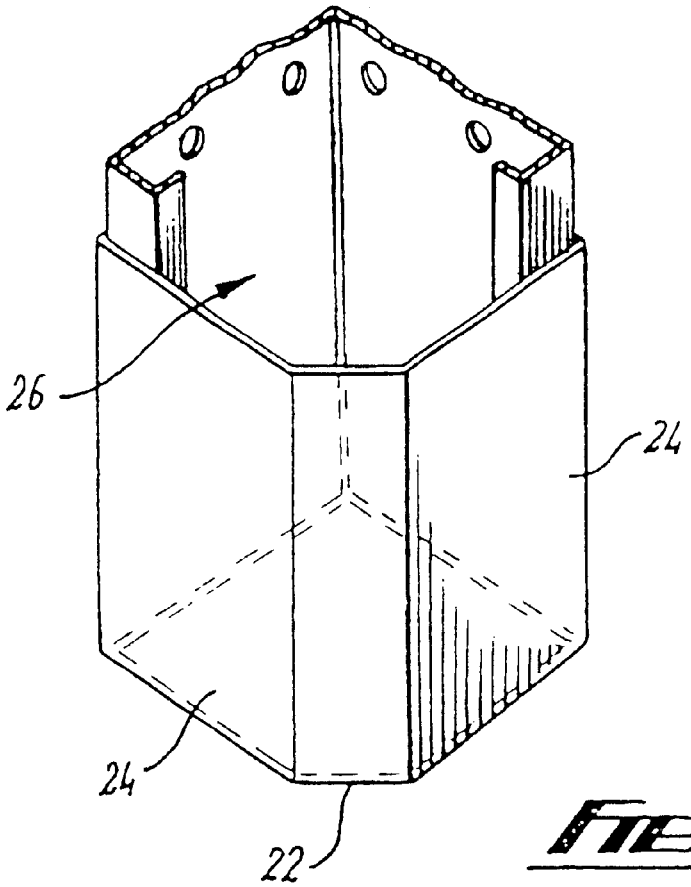

FIGS. 1 to 7 of the drawings show a bath lift 10 comprising a lifting arrangement 12 and seating means 14. The arrangement 12 comprises a bracket member 16. The member 16 has a generally L-shaped cross-section in plan view with channels 18 defined at the free end of each limb of the L. The channels 18 are defined by a cranked flange 20 defining a U-shape with the free ends of each limb. The lower end of the member 16 is closed off by a base plate 22 with upstanding side walls 24 extending upwardly therefrom for a short distance to define an upwardly open cavity 26. The base plate 22 and side walls 24 are formed as a separate unit as shown in FIG. 4, mounted on the remainder of the bracket member 16.

Figure 5:
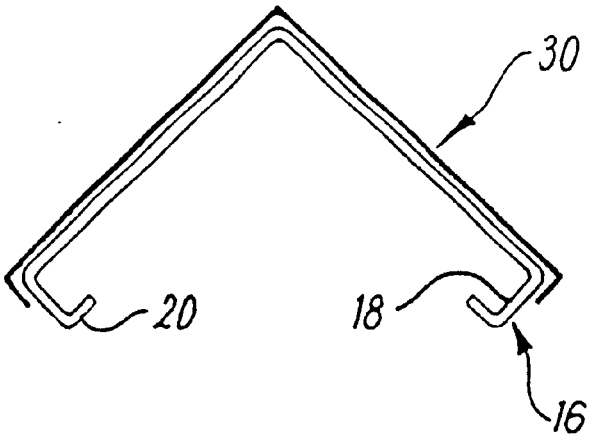
Figure 6:
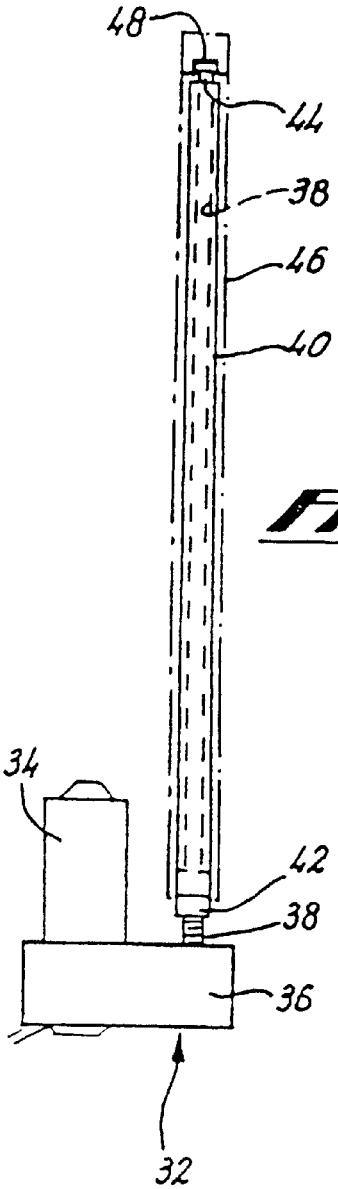

The bracket member 16 can be mounted directly onto a wall or fixture in a corner, or onto a single wall, using mounting holes 28. Alternatively, a mounting bracket 30 can be provided as shown in FIG. 5. The bracket 30 can be mounted onto a wall in any suitable manner. The bracket 30 is again of generally L-shaped cross-section in plan view and has inwardly turned flanges on the ends of the limbs of the L. The bracket 30 is shaped such that the member 16 can be slidingly fitted therein.

An electric motor assembly 32 is provided which is dimensioned to slidingly fit within the cavity 26. The assembly 32 comprises an electric motor 34 connected by reduction gearing located in a housing 36, to an upstanding threaded elongate member 38. An elongate first sleeve 40 is threadably mounted on the elongate member 38. The sleeve 40 may be mounted on the member 38 by for instance a threaded nut 42 at the lower end of the sleeve 40. A square section projection 44 is provided on the upper end of the sleeve 40. A second elongate sleeve 46 slidably locates over the sleeve 40. A square section recess 48 is provided on the underside of the top of the sleeve 46. The recess 48 is shaped to accept the projection 44 so as to prevent relative rotation between the sleeves 40 and 46.

A cradle 50 is mounted on the lower end of the sleeve 46. The cradle 50 is of a cross-section to slidingly locate within the bracket member 16, and has four rollers 52, two of which are locatable respectively in each of the channels 18. The cradle 50 comprises two plates 54 of generally triangular configuration which are spaced apart by three connecting members 56, two of which mount the rollers 52. Aligned holes 58 are provided in each of the plates 54 to accept the sleeve 46 passing therethrough. A mounting member 60 is locatable between the plates 54. A passage 62 is provided through the member 60 to accept the sleeve 46. A projection extends from an upper part of the member 60, with a threaded horizontal passage in which a bar 66 with a threaded end 68, is mountable. A cranked bar 70 extends from a lower part of the member 60.

Figure 7:
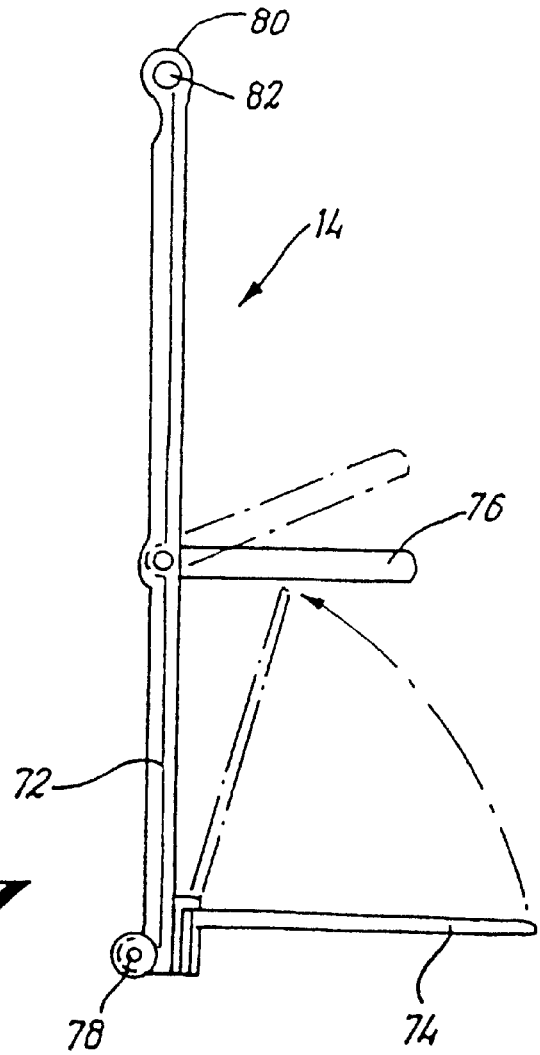

The seating means 14 comprises a seat with a back portion 72 and a base portion 74. The base portion 74 is pivotally mounted to the back portion 72 such that the portion 74 can be folded upwardly as illustrated in FIG. 7. A pivotal arm rest 76 may be provided part way up the back portion 70 as shown in FIG. 7. The arm rest 76 can also be pivotally mounted on the portion 72 as illustrated in FIG. 7. A pair of rollers 78 are provided at the lower end of the portion 72 on the rear side thereof. A sleeve 80 is provided extending along the top of the portion 72. The sleeve 80 has a circular section passage 82 extending therethrough.

The seating means 14 can be fitted on the lifting arrangement 12 by insertion of the bar 66 into the passage 82. The cranked bar 70 is locatable on the rearward side of the back portion 72. The back portion 72 and/or base portion 74 may be provided with reinforced ribs and may have openings extending therethrough. Passages could also be provided therein through which air can be blown to provide a spa bath effect.

In use, the lift 10 can be mounted in a number of orientations and positions relative to a bath. For instance, the lift 10 can be mounted against a single wall or in the corner of a room, and is generally mounted with the underside of the base plate 22 substantially level with the top of a bath 84. With the seating means 14 fitted on the lifting arrangement 12 as described above, the seating means will be at its lowest height when the cradle 50 is close to the motor assembly 32.

To raise the seating means 14 the motor 34 is actuated. This actuation may be via a hand-held waterproof control which could be used for example by a person using the bath lift 10. The motor 34 is actuated such that the member 38 rotates. Due to the coupling between the first and second sleeves 40, 46 the first sleeve 40 is prevented from any substantial rotational movement such that the member 32 engages with the nut 42 to cause the sleeve 40 and hence second sleeve 46 to rise. This causes the cradle 50 and thus seating means 14 also to rise. The motor 34 can obviously be actuated until a required height is reached. The lift 10 can be arranged such that the motor 34 stops automatically when predetermined upper and/or lower limits are reached. These limits may be adjustable.

Figure 1:
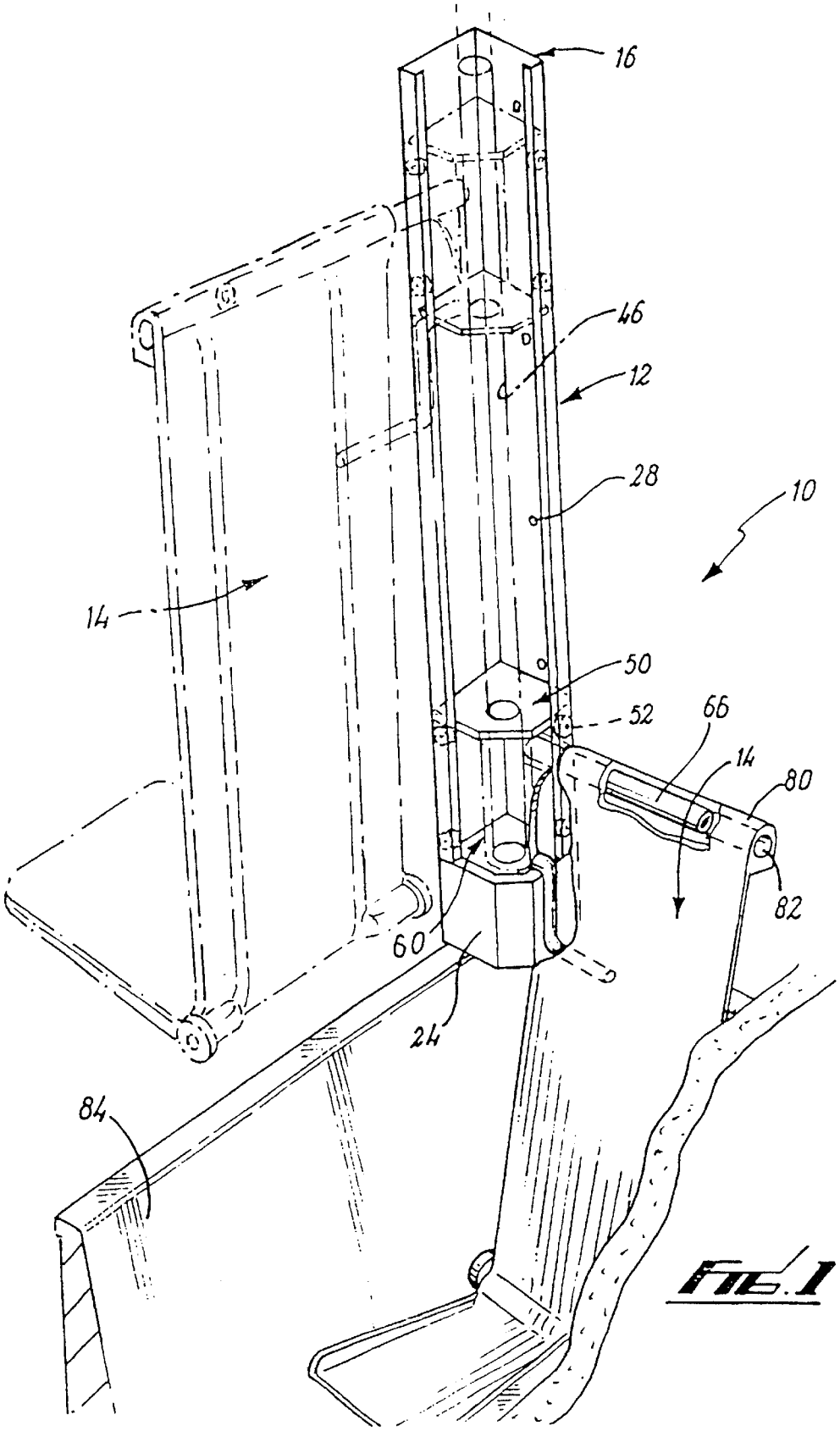
FIG.1 is a diagrammatic perspective view of a first bath lift according to the invention.
Figure 2:
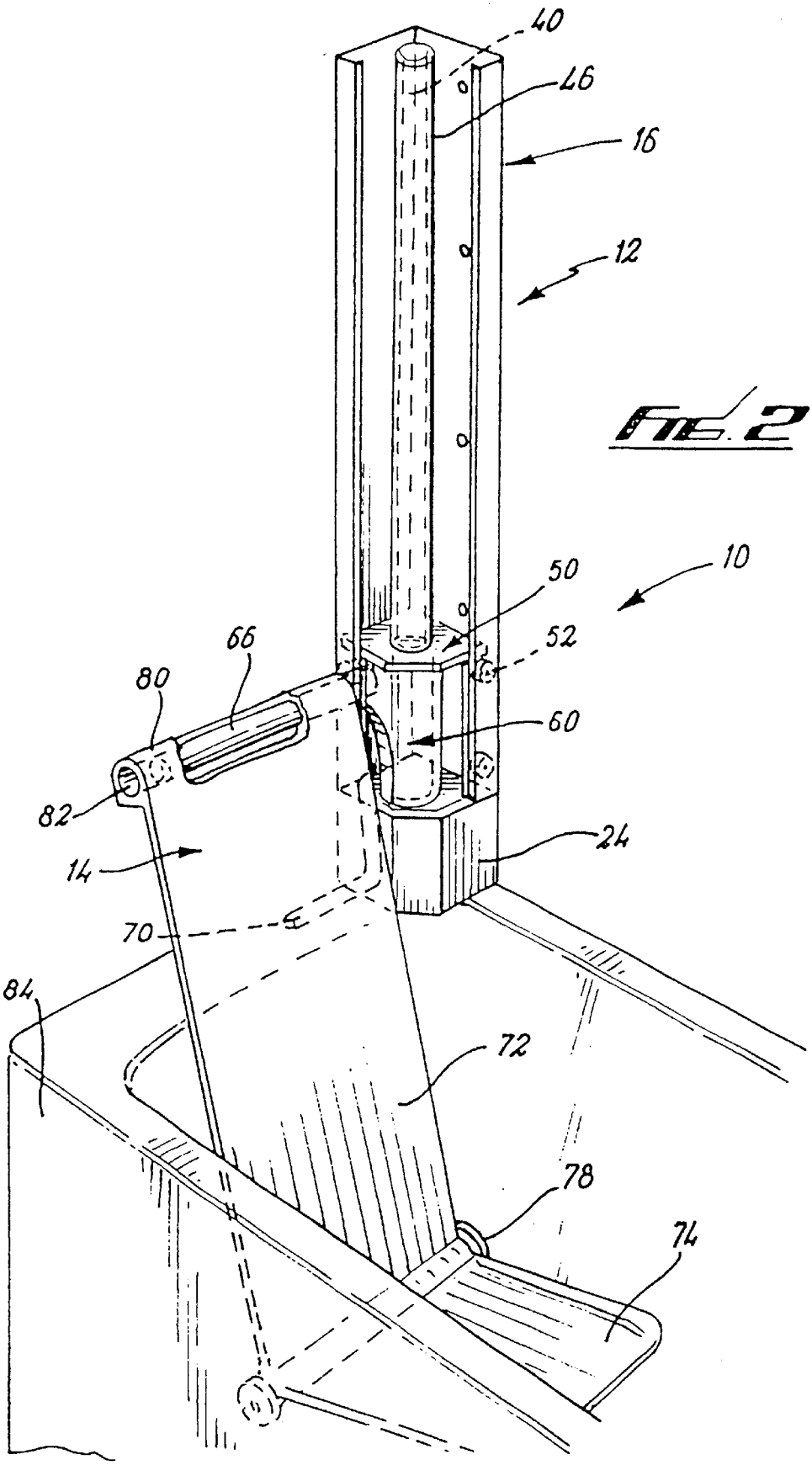
FIG. 2 is a similar view to FIG. 1 but with the lift in a different configuration.

The arrangement of the cradle 50 permits rotation thereof through substantially 90° as illustrated in FIG. 1 in broken lines, such that for instance the seating means 14 can be moved from over the bath to alongside the bath to enable a person to get on the seating means 14. The seating means 14 can obviously be lowered by opposite rotation of the member 32 which causes the sleeves 40, 46 and hence cradle 50 and seating means 14 to be lowered. As the seating means 14 is pivotally mounted on the bar 66 it can pivot forwards when being lowered into a bath for instance if the seating means 14 contacts the side or end of the bath, and the rollers 78 permit running over of the bath sides or end without damage thereto. This permits the lift 10 to be used with a wide variety of baths where the sides and/or ends are differently shaped and inclined, and to follow the profile of such baths. The cranked bar 70 prevents the seating means 14 from pivoting rearwardly beyond a predetermined limit. As the lifting arrangement 12 is to the side of the seating means 14, rather than behind it which is generally the case with bath lifts, a user can readily lie back on the seating means 14 and tilt their head rearwardly.

As noted above, the bath lift 10 can be fitted in a wide range of configurations next to for instance the outer side or inner side of a bath, and adjacent a corner of a room or on a single wall. The seating means 14 can readily be reversed and turned the other way on the bar 66 again with the cranked bar 70 engaging the rear side of the back portion 72.

The bath lift 10 can readily be installed without significant installation work and hence costs. The mounting bracket 30 can be affixed to a wall or walls in a conventional manner and the bracket member 16 slid thereonto. If the bracket 30 is omitted, the member 16 can be mounted onto a wall or walls in a conventional manner. The motor assembly 30 can be slidably located in the cavity 26. The elongate member 38 can readily be fitted on to the assembly 32 if not already fitted. The sleeve 40 can simply be threaded on to the member 38. The sleeve 46 with cradle 50 attached can simply be slid on to the sleeve 40 with the rollers 52 sliding along the channels 18. The seating means can subsequently be fitted by sliding the sleeve 80 over the bar 66. The motor 34 can be powered by the mains or by a battery pack in which case no connection to the mains would be required. The battery pack can obviously be rechargeable.

As well as being easy to install, the lift is of relatively straightforward constructions and can thus be inexpensively and robustly manufactured. In view of the configuration of the sleeves and also the engagement of the cradle in the bracket member, the weight of a person is borne along the length of the lifting arrangement. Due to the straightforward installation requirement, one or more components of the lift can readily be removed for repair, refurbishment or replacement. The seating means can readily be raised out of the bath to permit the bath to be used in a normal manner, and with the seating means raised above the bath it could readily be clipped or held against a wall with the base portion and arm rests folded up.

Figure 8:
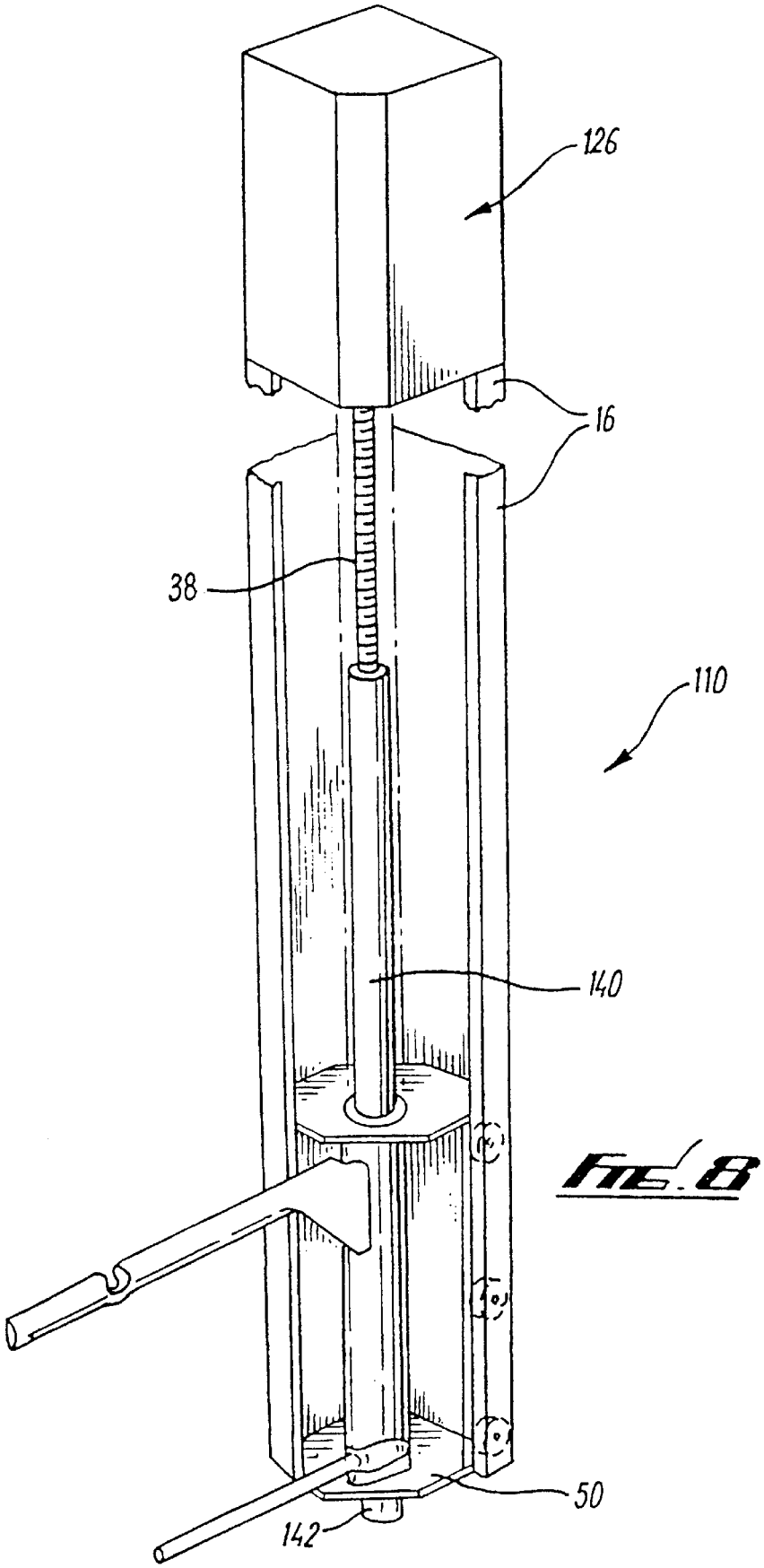
FIG. 8 is a diagrammatic perspective view of part of a second bath lift according to the invention.
Figure 9:
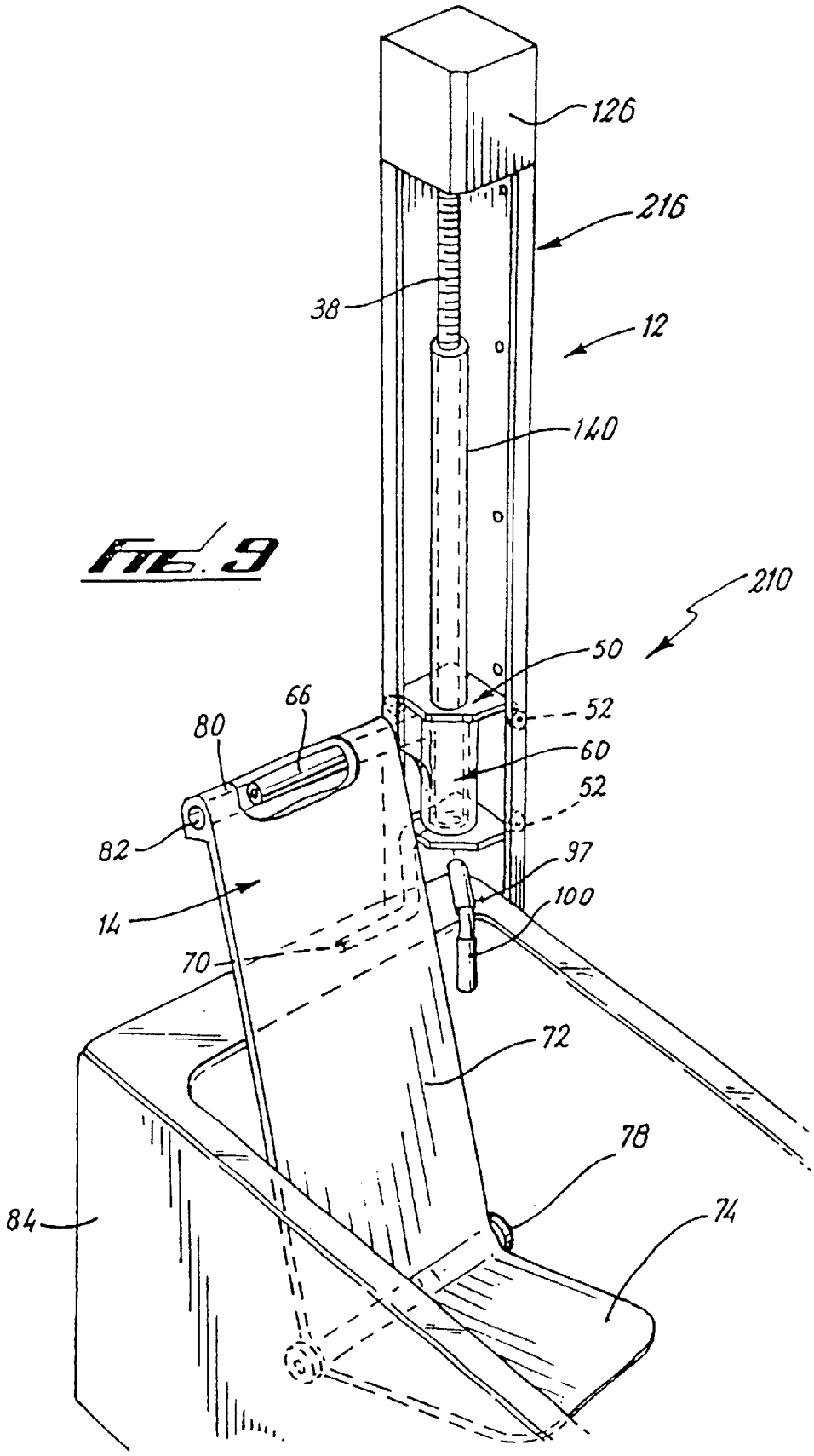
FIG. 9 is a similar view to FIG. 2 of a third bath lift according to the invention.
Figure 10:
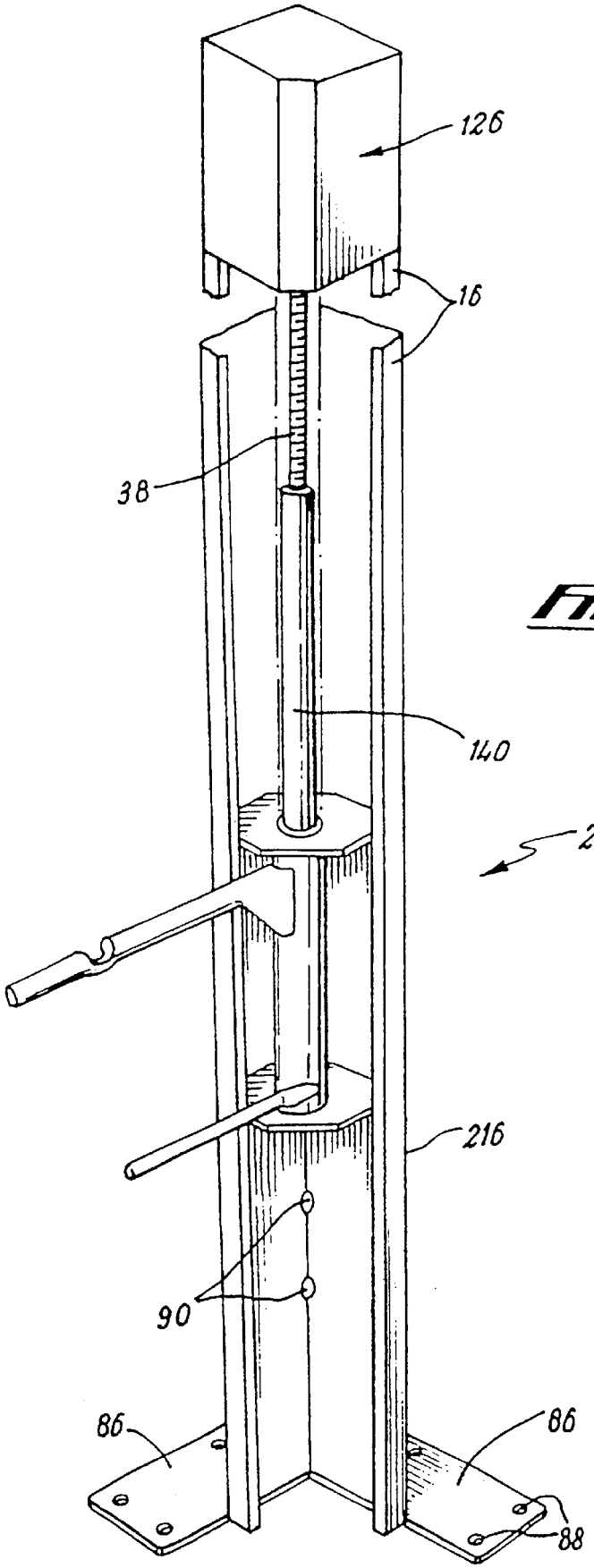
FIG. 10 is a similar view to FIG. 8 of the lift of FIG. 9.
Figure 11:
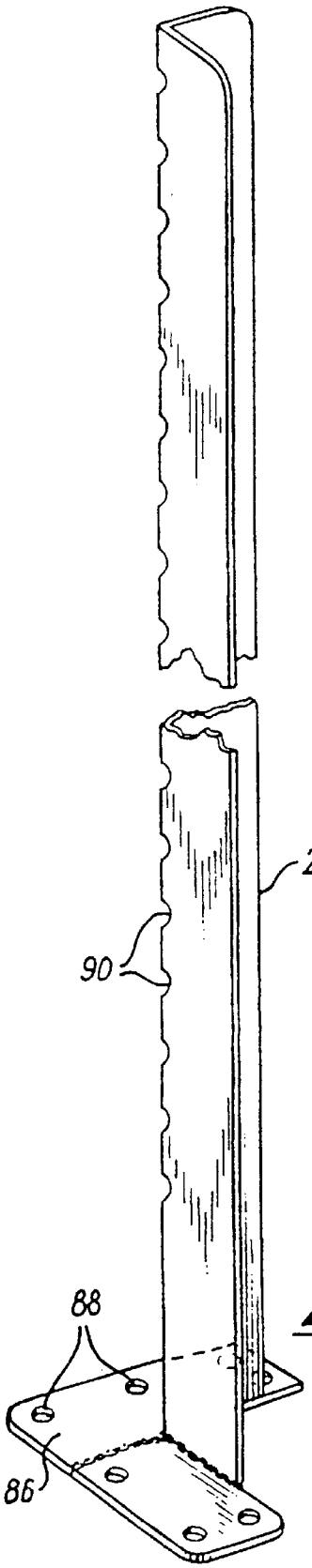
FIG. 11 is a diagrammatic perspective view of part of the lift of FIG. 9.
Figure 12:
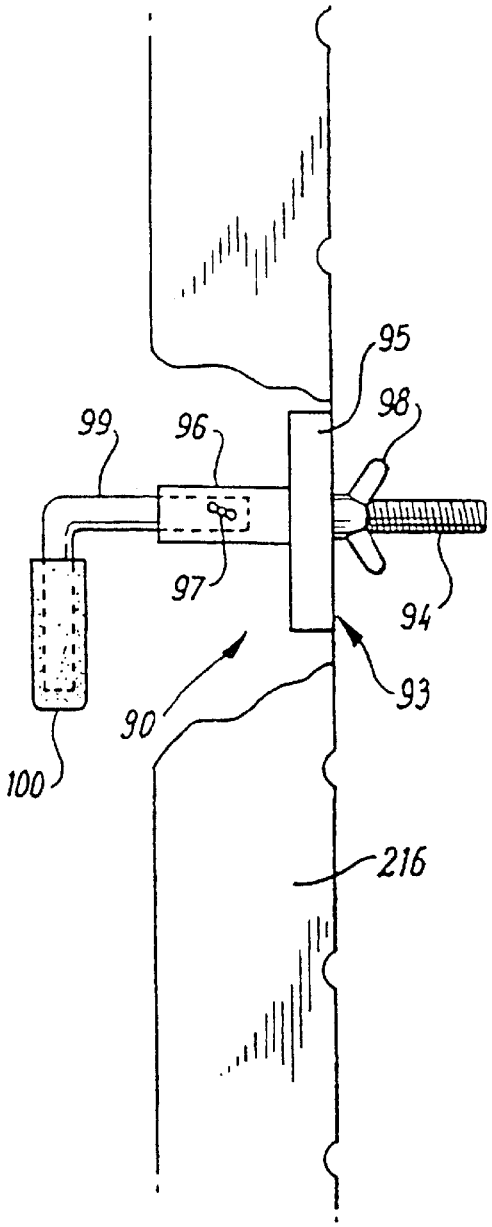
FIG. 12 is a diagrammatic sectional view of a further part of the lift of FIG. 9.

FIG. 8 of the drawings shows a second bath lift 110. The lift 110 is generally similar to the lift 10 and the same reference numerals will be used for similar or identical components. With the lift 110, the motor assembly 32 is located within a cavity 126 at the upper end of the bracket member 16. The assembly 32 is held within the cavity 126 but can be readily removed therefrom by for example removing parts of the cavity 126, for installation or maintenance. With the lift 110 the elongate member 38 points downwardly. A first sleeve 140 is threadably mounted on the elongate member 38 by a nut 142 at the lower end of the sleeve 140. The sleeve 140 is considerably shorter than the member 38. The cradle 50 fits on the lower end of the sleeve 140 in a similar manner as it fits on the sleeve 46 in the lift 10.

In use, the cradle 50 moves up and down as required by virtue of rotational engagement of the member 38 in the nut 142. The lift 110 is advantageous in a number of ways. As the apparatus is generally in-tension, only one sleeve is required thereby reducing the weight and construction costs. As the motor is located well clear of the seating means this provides for better access to the seating means.

FIGS. 9–12 of the drawings show a third bath lift 210. The lift 210 is generally similar to the lifts 10 and 110, and particularly the latter, and the same reference numerals will again be used for similar or identical components. The lift 210 is suitable for use where there is no adjacent wall or walls for mounting the lift thereon. With the lift 110 the mounting bracket 216 is provided with feet 86 such that the bracket 216 is mountable on the floor and upstanding therefrom. Mounting holes 88 are provided through the feet 86. A plurality of vertically spaced holes 90 are provided in the apex of the bracket 216. The holes 90 are usable with a mounting arrangement 92 for engagement with a bath 84 to prevent relative movement between the bath 84 and lift 210.

The mounting arrangement 92 comprises a first member 93 with a threaded projection 94. A plate 95 is provided at one end of the projection 94 and a socket 96 extends from the plate 95 coaxially with the threaded member 94. A grub screw 97 is provided extending into the socket 96 towards the open end thereof. The first member 93 is mountable on the bracket 216 at a required height, to a respective one of the holes 90. The member 93 is mountable with the threaded member 94 extending through the respective hole 90 with the plate 95 engaging against the inner apex of the bracket 216. A wing nut 98 provided on the threaded member 95 is used to hold the member 95 on the bracket 216. The arrangement 92 also comprises a second member 99 which is L-shaped and has a plastic or rubber sleeve 100 on one limb to protect the bath 84. The other limb of the member 99 is locatable in the socket 96 at a required position for the sleeved member to engage against the side of the bath 84, and the member 99 can be held in this position by the grub screw 97.

The lift 210 therefore permits all the advantages of the lifts 10 and 110 to be provided where an adjacent wall or walls is not available. As with the lifts 10, 110, a mounting bracket could be provided on which the bracket member 216 could be fitted, to ease assembly and disassembly of the lift 210. In this instance, the bracket member 216 would not require feet, and these would only be provided on the mounting bracket.

Various other modifications may be made without departing from the scope of the invention. For instance, different power means could be provided which could incorporate a jack or other lifting arrangement. The bracket member and cradle could be otherwise arranged. Different means could be used to prevent relative rotation between the two sleeves. The seating means could be mounted on the lifting arrangement in a different manner. A flexible cover may be provided around the threaded member above and/or below the seating means. The cover may comprise a flexible sleeve with a bellows configuration.

Lifts according to the invention could be used to raise and lower supine patients into a bath. In such an arrangement two lifts would be provided spaced apart along a bath, with for instance a slatted support member extending between respective seating means. The bath lifts would probably be arranged to move synchronously. As a further alternative, lifts according to the invention could be used for lowering people onto a toilet seat and raising them therefrom. In such an arrangement the lift will be locatable next to the toilet, and the seating means would include a toilet seat.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A bath lift for lowering a person into a bath tub, the lift comprising:

a) a lifting arrangement mountable on a selected one of on a top of the bath tub near a corner of the bath tub and adjacent the bath tub;

b) the lifting arrangement including a tower supporting an elongate threaded member and a lifting part threadably engaging the threaded member;

c) seating means including an occupant seat and a seat support connected to the lifting part, the seat and support being moveable about an axis of the threaded member between over the tub and beside the tub positions;

d) the lifting arrangement further including a drive operably connected to the threaded member and the lifting part for effecting relative rotation and thereby vertical movement when the threaded member axis is vertical;

e) the lifting part including a carriage coacting with the seat support to provide relative pivotal movement of the seating means and the lifting part about a horizontal axis whereby inclination of the seating means can be varied;

f) the tower further including a pair of tracks in guiding engagement with the carriage when the drive is operated to effect relative movement of the lifting part and the member axially of the threaded member;

g) said tower further including a frame member, the frame member having a generally L-shaped cross-section in plan view;

h) means for directly mounting said frame member to a selected one of a wall and a fixure; and i) a mounting bracket and means for slidably mounting said frame member on said mounting bracket.

* * * * *